US005483786A

United States Patent [19]

Giesbrecht et al.

[11] Patent Number: 5,483,786

[45] Date of Patent: Jan. 16, 1996

[54] APPARATUS FOR PACKAGING ARTICLES

[75] Inventors: Ken Giesbrecht, Jordan Station; Stefan Gudmundsson, Georgetown, both of Canada

[73] Assignee: Technopac, Inc., Canada

[21] Appl. No.: 128,297

[22] Filed: Sep. 29, 1993

Related U.S. Application Data

[63] Continuation-in-part of Ser. No. 69,732, Jun. 1, 1993.

[51] Int. Cl.[6] ..... B65B 43/34

[52] U.S. Cl. ..... 53/570; 53/64; 53/67; 53/257; 53/258; 53/576; 53/385.1

[58] Field of Search ..... 53/64–67, 174, 53/257, 258, 285, 384.1, 385.1, 386.1, 390, 570, 571, 572, 556, 575, 512

[56] References Cited

U.S. PATENT DOCUMENTS

| | | | |
|---|---|---|---|
| 3,455,088 | 7/1969 | Lerner | 53/385.1 |
| 3,719,022 | 3/1973 | Cherio et al. | 53/285 |
| 3,774,367 | 11/1973 | Lerner | 53/570 X |
| 3,930,352 | 1/1976 | Carnes | 53/189 |
| 3,935,691 | 2/1976 | Broch . | |
| 4,248,032 | 2/1981 | Woods et al. | 53/570 |
| 4,457,124 | 7/1984 | Hartmann | 53/512 |
| 4,590,748 | 5/1986 | Harrison et al. | 53/576 |
| 4,689,937 | 9/1987 | Finan, Sr. et al. | 53/570 X |
| 4,696,146 | 9/1987 | Esch et al. | 53/529 |

FOREIGN PATENT DOCUMENTS

| | | |
|---|---|---|
| 2250672 | 6/1975 | France . |
| 1444909 | 8/1976 | United Kingdom . |
| 1591884 | 7/1981 | United Kingdom . |

*Primary Examiner*—W. Donald Bray
*Attorney, Agent, or Firm*—Fitzpatrick, Cella, Harper & Scinto

[57] ABSTRACT

An apparatus for packaging articles straddles a conveyor line delivering articles to be packaged. In one embodiment, the apparatus includes an article holding unit moveable linearly between a retracted position wherein it is positioned to one side of the conveyor line and an operative position wherein it is positioned downstream of the conveyor line so that it receives and holds an article arriving at the apparatus. A bag transfer unit is also moveable linearly between a first position to one side of the conveyor line opposite that of the article holding unit, to retrieve the bag in which the article is to be placed and a second position to pull the bag over at least a portion of the article holding unit and the article held thereby. As the bag transfer unit draws a bag over the article and the article holding unit, the article holding unit is moved to its retracted position allowing the bagged article to fall to another conveyor line and be carried away from the apparatus. In another embodiment, the article holding unit and bag transfer unit are incorporated into a single article bagging assembly. The assembly is moveable along a linear slide to one side of the conveyor to retrieve a bag and to position the assembly to receive the article to be packaged. Once the article is received by the assembly and the bag has been retrieved, the article is pushed into the bag and the bagged article is released allowing it to fall to the conveyor line and be carried away from the apparatus.

29 Claims, 12 Drawing Sheets

APPARATUS FOR PACKAGING ARTICLES

This application is a continuation-in-part of Ser. No. 08/069,732, filed Jun. 1, 1993.

FIELD OF THE INVENTION

The present invention relates to packaging equipment and in particular to an apparatus for packaging articles such as foodstuffs and the like.

BACKGROUND OF THE INVENTION

Packaging equipment is commonly used in industry to package articles to be sold. In the food industry, the advantages associated with automated packaging equipment are two-fold. Not only does the use of automated equipment to package food articles reduce labour costs but also minimizes contact between labourers and the food articles being packaged. From a health standpoint, this latter advantage is very significant.

Many different automated devices have been considered to package articles. For example, U.S. Pat. No. 3,455,088 to Lerner shows a container delivery apparatus. The apparatus includes a housing in which a continuous roll of plastic bags is located. The bags are separated by perforations formed along the roll at spaced intervals. An air blowing mechanism is located in the housing to inflate the individual bags as they leave the housing to facilitate placement of an article in the bag leaving the housing.

U.S. Pat. No. 3,719,022 to Cherio et al discloses a device for inserting foodstuff into netted containers. The device includes a tube to hold the foodstuff to be packaged and a support bench over which is located a roll of netting. A ram on the support bench has jaws on it to engage the netting. After the netting has been engaged by the jaws, the ram is reciprocated to collect a predetermined amount of netting. The collected netting is then pulled over the foodstuff held in the tube. The tube is then withdrawn and the ends of the netting are sealed to package the foodstuff.

U.S. Pat. No. 4,248,032 to Woods et al discloses a bagging apparatus for inserting a carton into a bag. The cartons to be bagged arrive at a loading station via a conveyor. When a carton arrives at the loading station, a reciprocating pusher moves the carton from the loading station into a bag held open by a bag grasping unit. Once the carton is pushed into the bag, the pusher is retracted and the bag with the carton in it is released by the bag grasping unit and is carried away by another conveyor.

U.S. Pat. No. 4,457,124 to Hartmann discloses a bag packaging machine for bread. The machine includes a conveyor for delivering loaves of bread to be bagged. A suction unit grabs the bag to be filled and spreaders reach into the bag to open it. At that time, a pusher pushes a loaf of bread into the bag and then creates a vacuum to draw air out of the bag. A sealing device then seals the bag and the pusher releases the bag so that a conveyor may carry the bag away from the machine.

U.S. Pat. No. 4,590,748 to Harrison et al shows a machine for packaging articles. The machine includes a support for the articles to be packaged and a moveable shuttle to draw netting over the articles. Once the netting has been drawn over the articles, a sealing device seals the netting at its ends to package the articles.

U.S. Pat. No. 4,689,937 to Finan, Sr. et al discloses an article bagging unit particularly useful for bagging ice. The unit includes a blower which partially opens a bag. A pair of fingers are then used to open the bag fully. Once the bag is fully opened, the ice to be bagged is deposited in the bag and the fingers are retracted. The open end of the bag is then heat sealed.

U.S. Pat. No. 3,930,352 to Carnes discloses a packaging machine for packaging bread into flexible bags. The machine uses a jet of air to inflate the top bag in the stack so that articulated scoops can enter the bag interior and open to engage the bag. Once this is done, the scoops act as a funnel to guide the bread into the bag as it is pushed by pusher arm assemblies. Although this machine works satisfactorily, it is complicated and due to its many moving parts is quite large and is prone to mechanical failure.

Although many devices have been considered to package goods, improved devices to facilitate packaging and to increase speed are continually being sought. Thus, there remains the need for an improved apparatus for packaging articles.

It is therefore an object of the present invention to provide a novel apparatus for packaging articles.

SUMMARY OF THE INVENTION

According to one aspect of the present invention there is provided an apparatus for packaging articles comprising:

an article holding unit to receive and hold an article to be packaged;

a bag transfer unit to carry a bag in which said article is to be placed; and a drive acting on said article holding unit and said bag transfer unit, said drive reciprocating said article holding unit between an article holding position and a retracted position to one side of said apparatus and reciprocating said bag transfer unit between a bag collecting position adjacent an opposite side of said apparatus and an article packaging position wherein a bag carried by said bag transfer unit surrounds an article held by said article holding unit when in said article holding position.

Preferably, in the packaging position the bag also surrounds at least a portion of the article holding unit. It is also preferred that the apparatus further includes a stop contacting an article held by the article holding unit and inhibiting movement of the article when the drive moves the article holding unit to the retracted position. Preferably, the stop includes a stop arm moveable between an operative condition to contact an article held by the article holding unit in the article holding position and an inoperative condition when the article holding unit is in the retracted position.

Preferably, the article holding unit and the bag transfer unit are moveable along linear slides in line with one another, the article holding and bag transfer units moving towards the centre of the apparatus in the article holding and article packaging positions respectively. It is also preferred that the drive moves the bag transfer unit towards the bag collecting position when the article holding unit is moved from the article holding position to the retracted position.

Preferably, the article holding unit includes a holder having a top portion and a bottom portion between which an article is held, the top and bottom portions being vertically spaced and moveable relative towards one another to compress an article held therebetween. It is preferred that the top portion is moveable towards the bottom portion with the top portion being pivotally mounted to the article holding unit. Preferably, the article holding unit further including a second drive acting between the top and bottom portions to pivot the top portion to move it relative to the bottom portion. It is also preferred that the apparatus further includes adjustment means to alter the vertical spacing between the top and bottom portions to accommodate different size articles to be packaged.

Preferably, the apparatus further includes a bag holding mechanism adjacent the opposite side, the bag transfer unit being operable to collect a bag held by the bag holding mechanism and carry it to the article packaging position. It is preferred that the bag holding mechanism is removably mounted on the apparatus. In one embodiment, the bag holding mechanism is in the form of a roll stock machine while in another embodiment the bag holding mechanism is the form of at least one wicket which supports a stack of preformed bags.

According to another aspect of the present invention there is provided an apparatus for packaging articles comprising:

an article holding unit to receive and hold an article to be packaged, said article holding unit including a holder having a top portion and a bottom portion between which an article is held, said top and bottom portions being moveable relative towards one another to compress an article held therebetween;

a bag transfer unit to carry a bag in which said article is to be placed; and a drive acting on said article holding unit and said bag transfer unit, said drive moving said article holding unit between an article holding position and a retracted position and moving said bag transfer unit between a bag collecting position and an article packaging position wherein a bag carried by said bag transfer unit surrounds said article held by said article holding unit when in said article holding position.

According to another aspect of the present invention there is provided an apparatus for packaging articles comprising:

an article bagging assembly to receive and package an article; and a drive acting on said article bagging assembly, said drive reciprocating said article bagging assembly between a bag collecting position adjacent one side of said apparatus wherein a bag can be collected by said assembly and an article packaging position wherein the article to be packaged is received by said assembly, said drive operating said assembly so that the bag carried by said assembly surrounds the article held in said article holding position.

BRIEF DESCRIPTION OF THE DRAWINGS

Embodiments of the present invention will now be described more fully with reference to the accompanying drawings in which.

Figure 1:
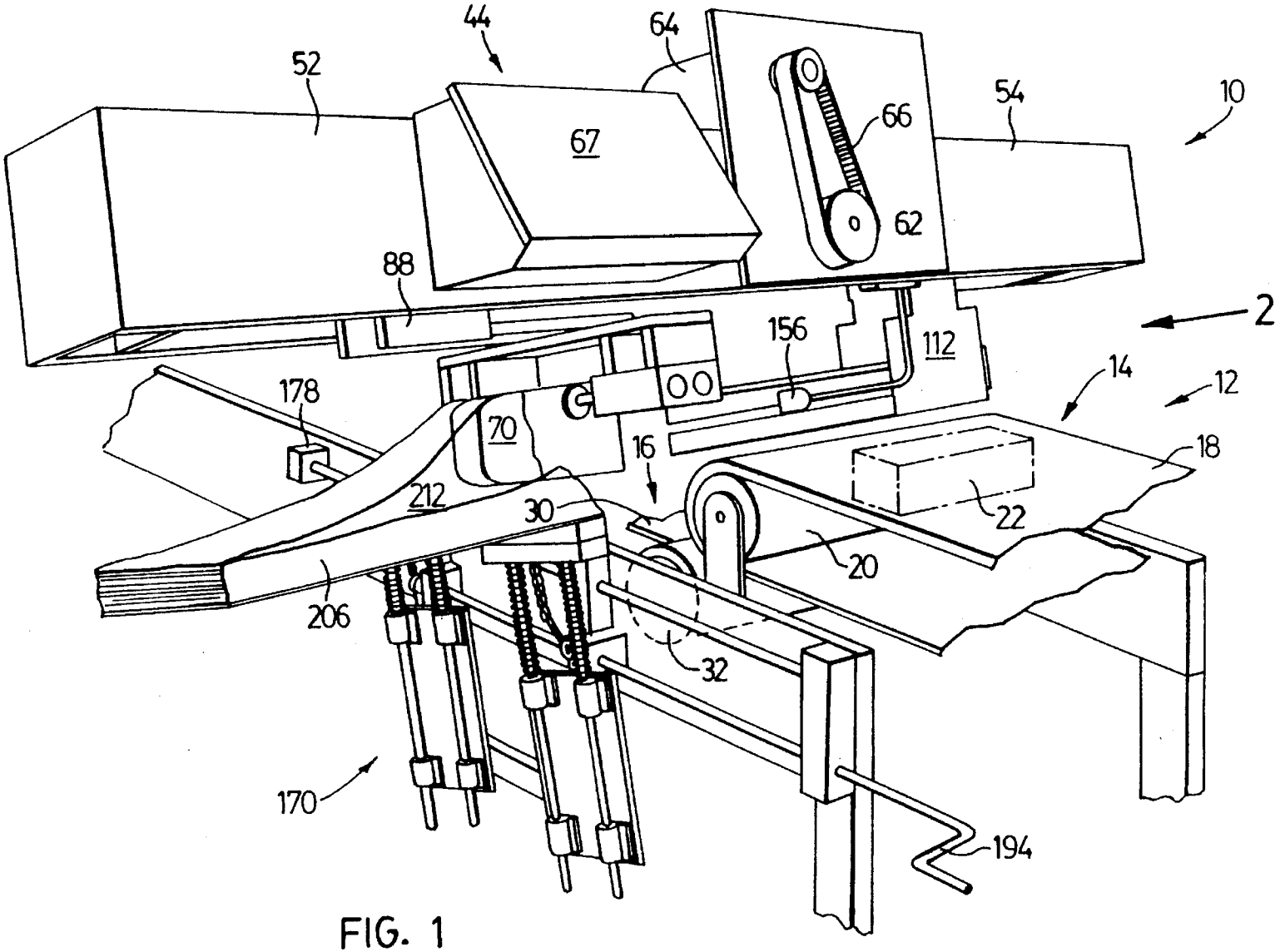
FIG. 1 is a perspective view of a conveyor system with an apparatus for packaging articles straddling the conveyor line.
Figure 8:
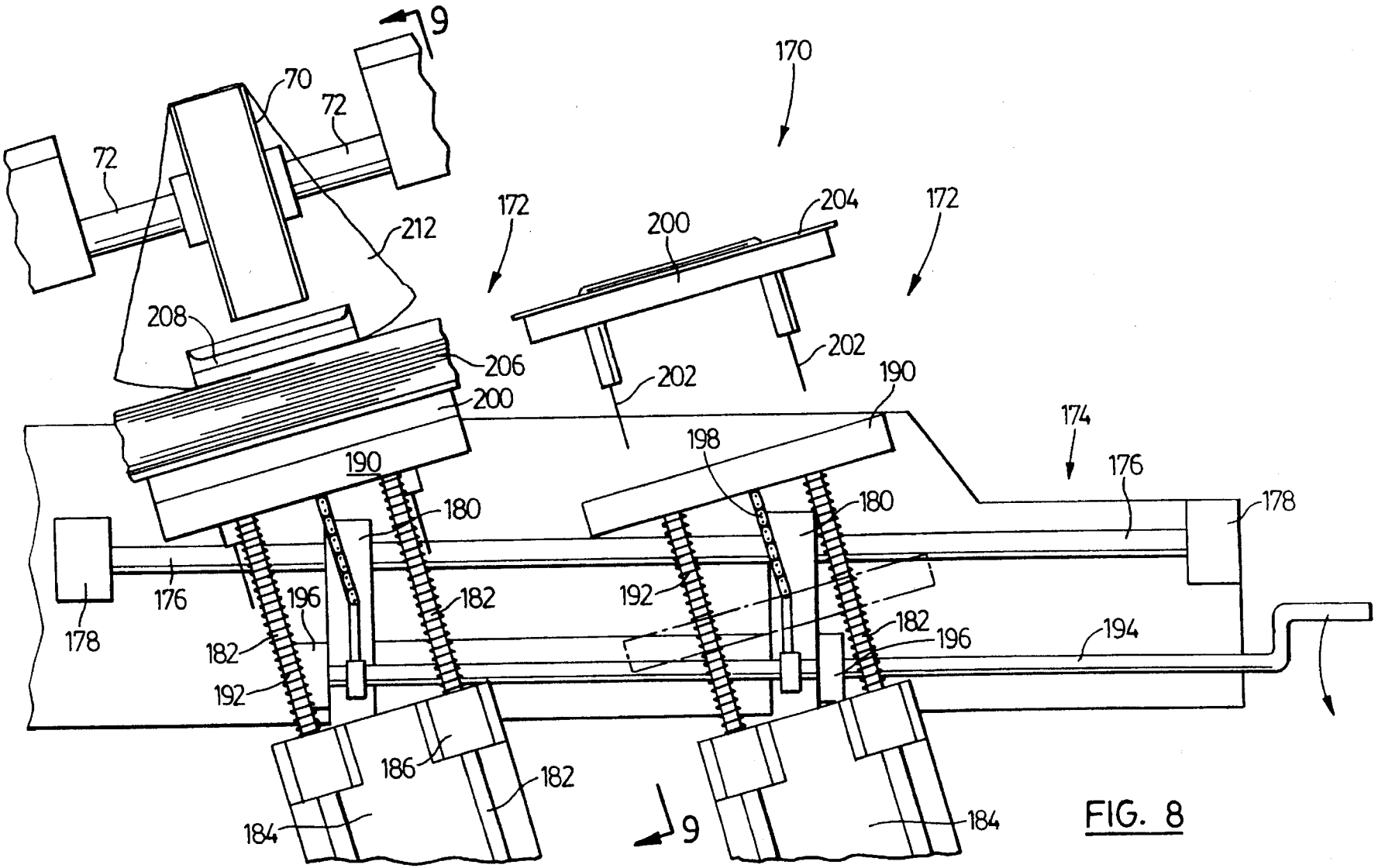
Figure 9:
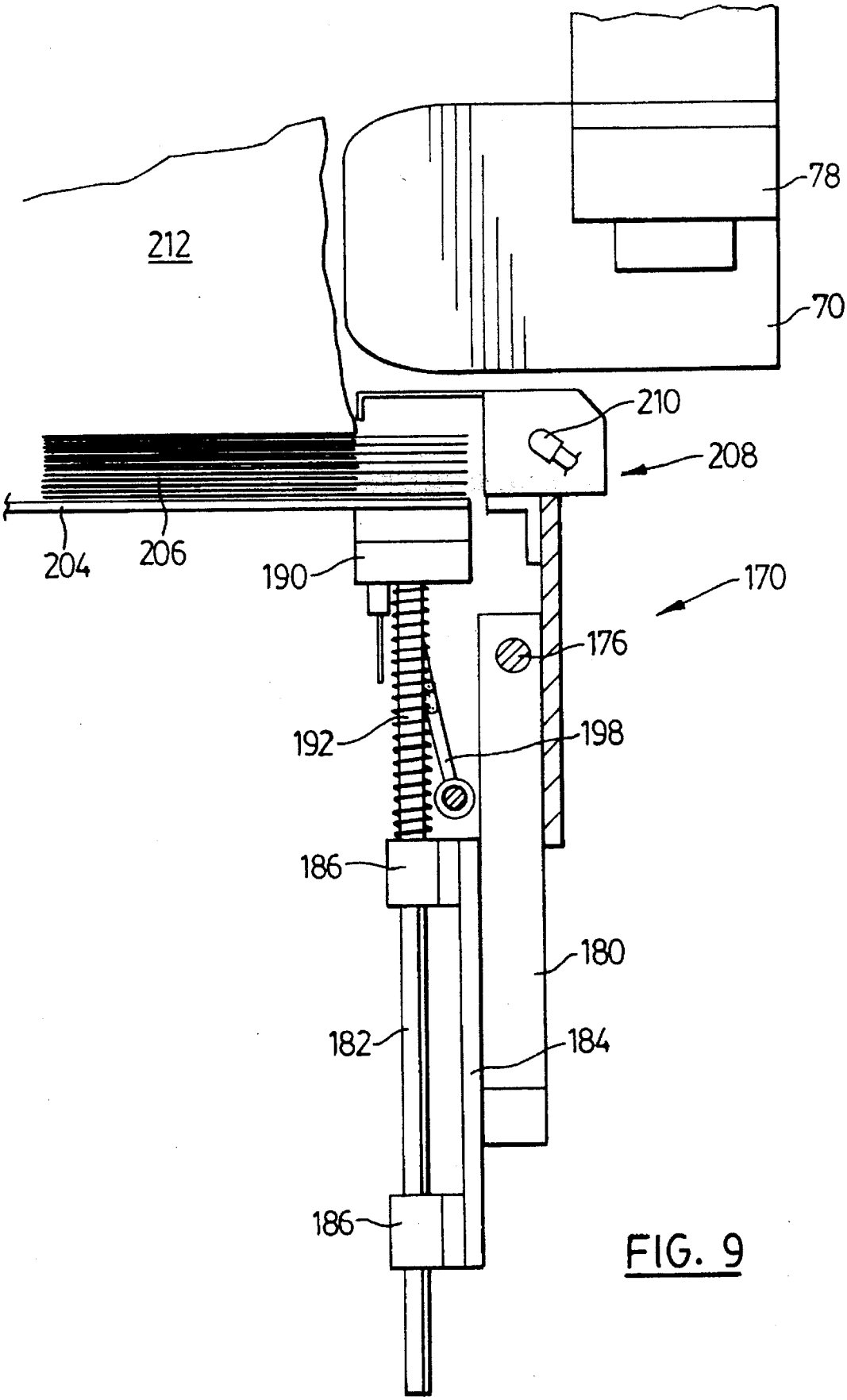
Figure 10:
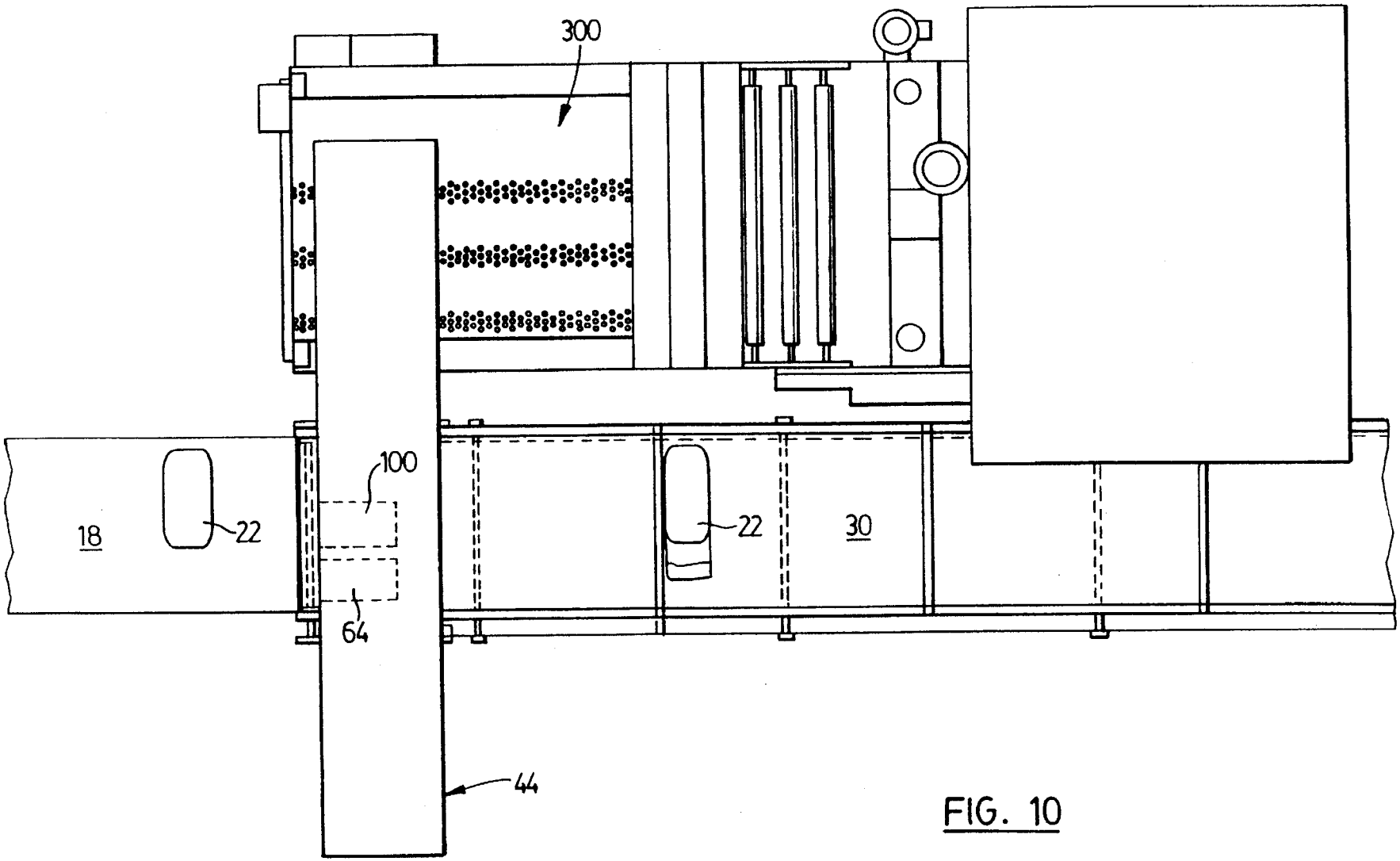
Figure 11:
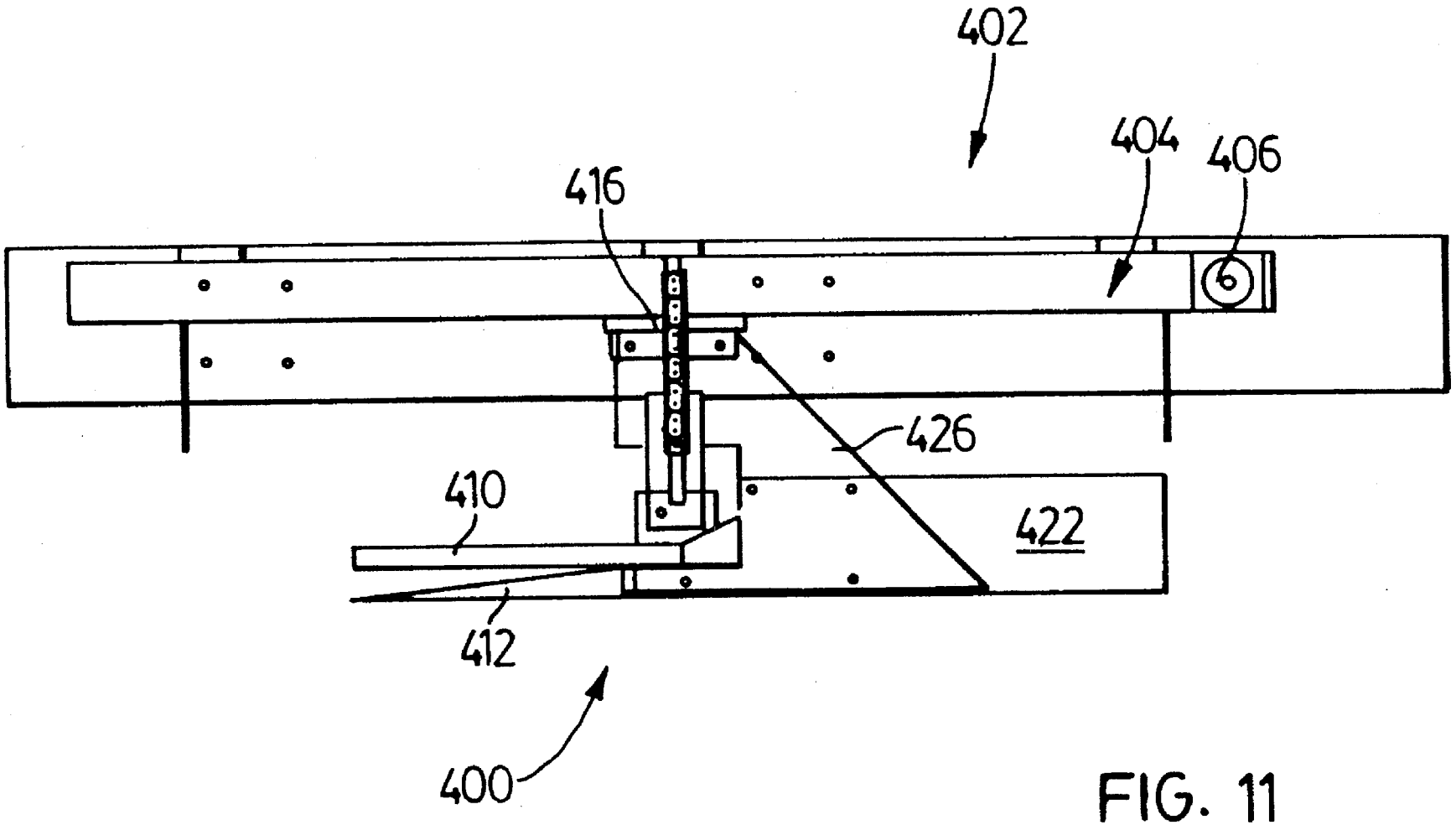
Figure 13:
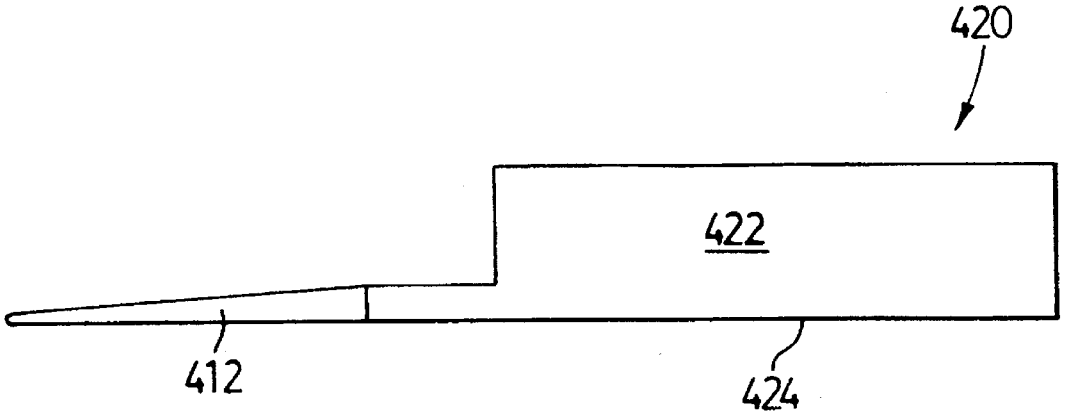
Figure 12:
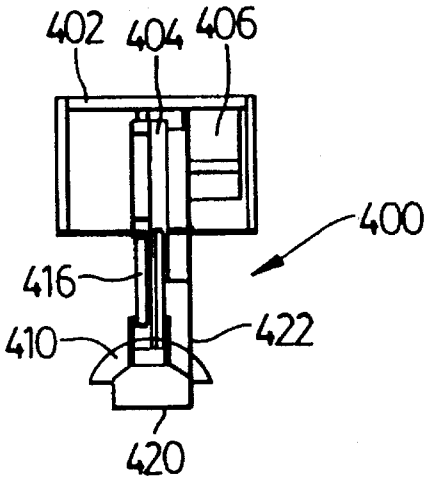
Figure 14B:
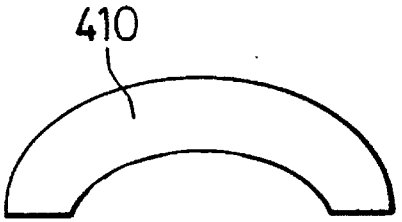
Figure 14A:
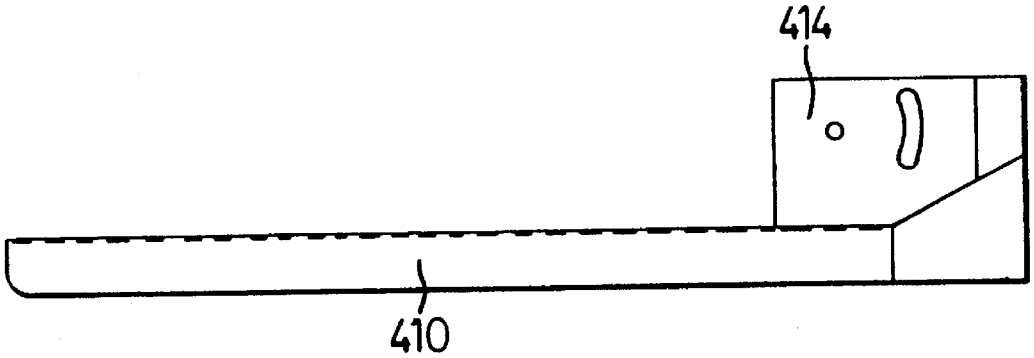

FIGS. *7a*, *7b*, *7c*, *7d* and *7e* are schematic view of the apparatus for packaging articles shown in FIG. 1 showing the various stages of its operation;

FIG. 8 is an enlarged perspective view of yet another portion of the apparatus for packaging articles shown in FIG. 1;

FIG. 9 is a sectional view of the portion illustrated in FIG. 8 taken along line 9—9;

FIG. 10 is a top plan view of an alternative embodiment of an apparatus for packaging articles;

FIG. 11 is a side view of a portion of yet another alternative embodiment of an apparatus for packaging articles;

FIG. 12 is a front view of the portion illustrated in FIG. 11;

FIG. 13 is a side view of an element of an article bagging assembly forming part of the portion illustrated in FIG. 11;

FIG. 14*a* is a side view of another element of the article bagging assembly; and FIG. 14*b* is a front view of a portion of the element illustrated in FIG. 14*a*.

DESCRIPTION OF THE PREFERRED EMBODIMENTS

Figure 2:
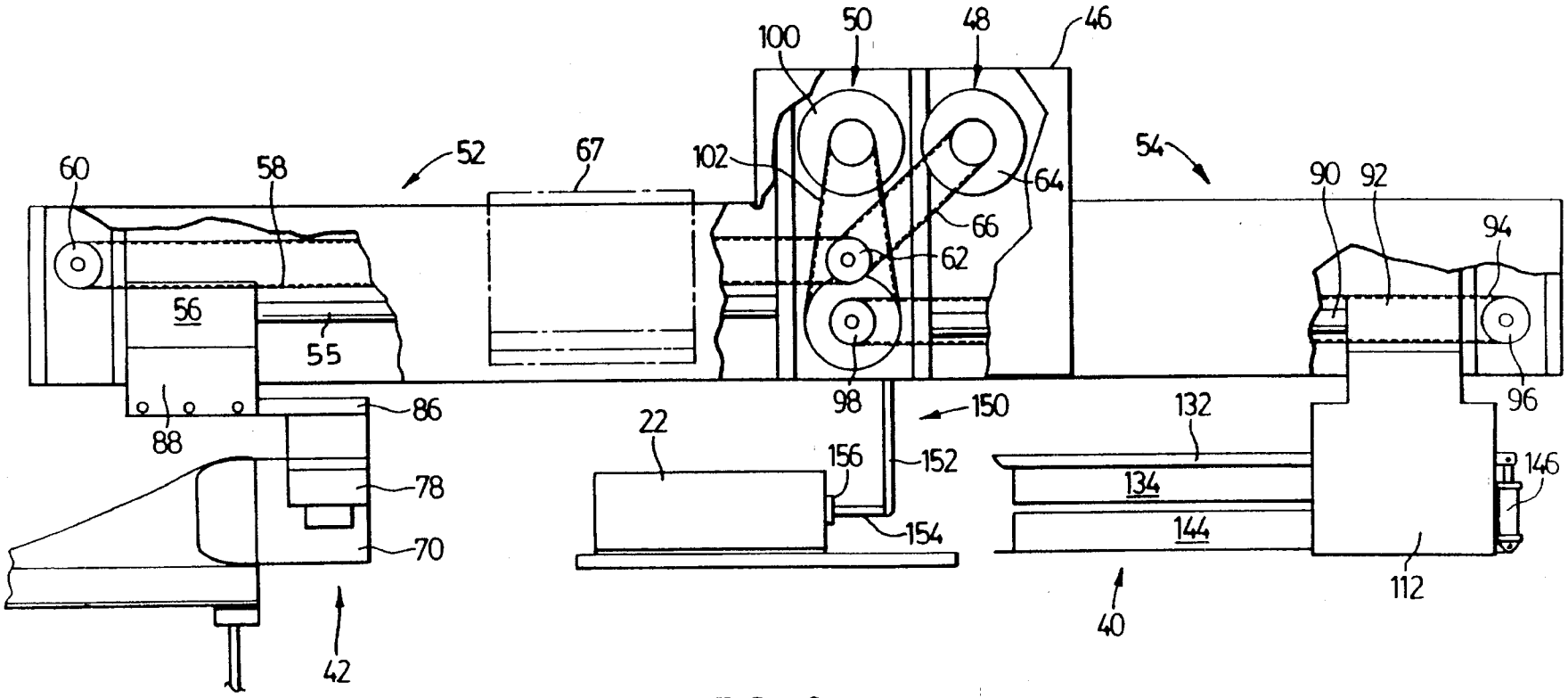
FIG. 2 is an elevational view, partly broken away, of the conveyor system shown in FIG. 1 taken in the direction of arrow 2.

Referring now to FIGS. 1 and 2, an apparatus for packaging articles is shown and is generally indicated by reference numeral 10. In this particular example, the apparatus 10 is shown packaging loaves of sliced bread, although it should be apparent to one of skill in the art that the apparatus may be used to package other types of articles. The apparatus 10 straddles a conveyor system 12 including a delivery conveyor line 14 and a transport conveyor line 16. The delivery conveyor line 14 includes an endless belt 18 wound about a head pulley (not shown) and a tail pulley 20. The head pulley is coupled to a motor (not shown) to allow the motor to impart rotation of the head pulley and hence move the endless belt 18. The conveyor line 14 receives articles to be packaged, in this case the loaves of sliced bread 22, near the head pulley and delivers them to the apparatus 10 via the belt 18 at spaced intervals.

The transport conveyor line 16 is positioned below conveyor line 14 and receives packaged bread from the apparatus 10. Similar to the conveyor line 14, the transport conveyor line 16 includes an endless belt 30 wound about a head pulley 32 and a tail pulley (not shown). The tail pulley is coupled to a motor (not shown) so that packaged loaves of bread can be carried away from the apparatus 10.

The apparatus 10 is located slightly downstream of the delivery conveyor line 14 but is positioned above the transport conveyor line 16 so that articles carried by the conveyor line 14 are delivered to the apparatus 10 and once packaged, are dropped by the apparatus 10 onto the transport conveyor line 16. To achieve this function, the apparatus 10 includes an article holding unit 40 and a bag transfer unit 42 both of which are mounted on a linear slide frame 44 above the conveyor system 12. Although not shown, the frame 44 is supported above the conveyor system 12 by a frame structure.

The linear slide frame 44 includes a central housing 46 in which a pair of drive mechanisms 48 and 50 are located. Extending outwardly from opposite sides of the housing 46 are a pair of linear slides 52 and 54 respectively. Linear slide 52 is associated with the bag transfer unit 42 while linear slide 54 is associated with the article holding unit 40. FIG. 2 best illustrates the linear slide 52 and as can be seen it includes a guide shaft 55 extending the length of the linear slide. The shaft 55 passes though an opening in a mount 56.

The mount 56 houses linear bearings to facilitate its movement along the shaft 55. The top of the mount 56 is secured to an endless drive belt 58 which is wound around a pair of pulleys 60 and 62 located at opposite ends of the linear slide 52. The pulley 62 is coupled to a reversible motor 64 in housing 46 by way of belt 66. The motor 64 and belt 66 form the drive mechanism 48.

Rotation of the motor 64 in either direction imparts rotation of pulley 62 via the belt 66. This action winds the belt 58 about the pulleys 60 and 62 to reciprocate the bag transfer unit 42 between a bag collecting position and an article packaging position as will be described. A control housing 67 is located on the linear slide frame 44 adjacent the linear slide 52. Within the housing 67 is a control panel (not shown) on which a number of push buttons are located to allow an operator to start and stop the apparatus 10 as required. A controller (not shown) communicates with the buttons and with an electronic sensor (not shown) and initiates operation of the apparatus 10 in response to the buttons being pushed and input from the electronic sensor as will be described.

Figure 3:
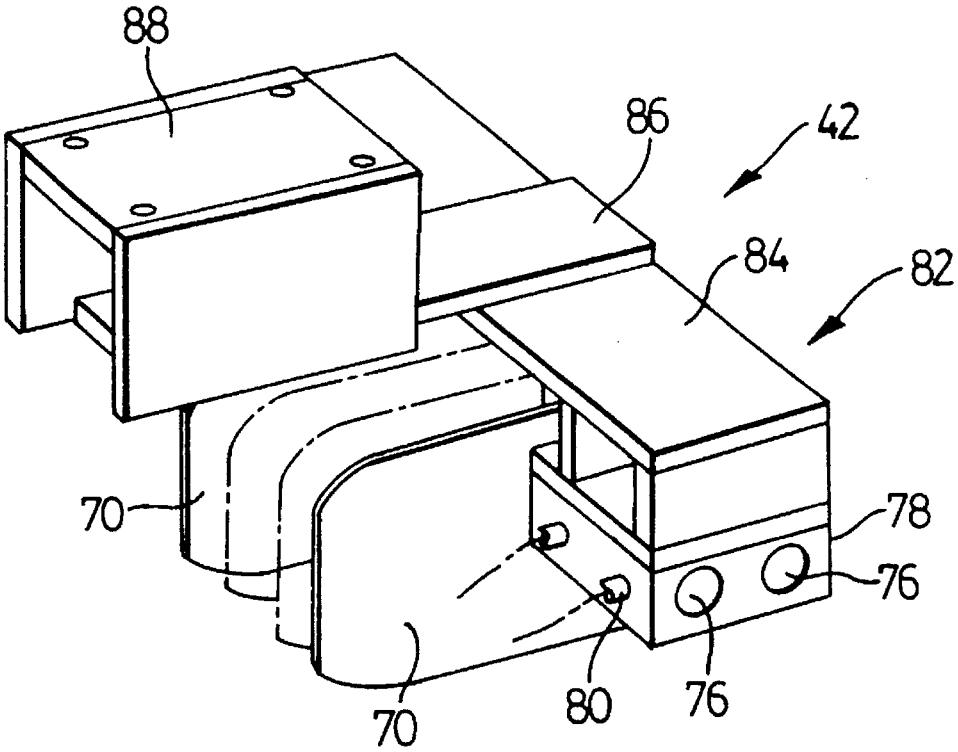
FIGS. 3 and 4 are enlarged perspective views of a portion of the apparatus for packaging articles shown in FIG. 1.
Figure 4:
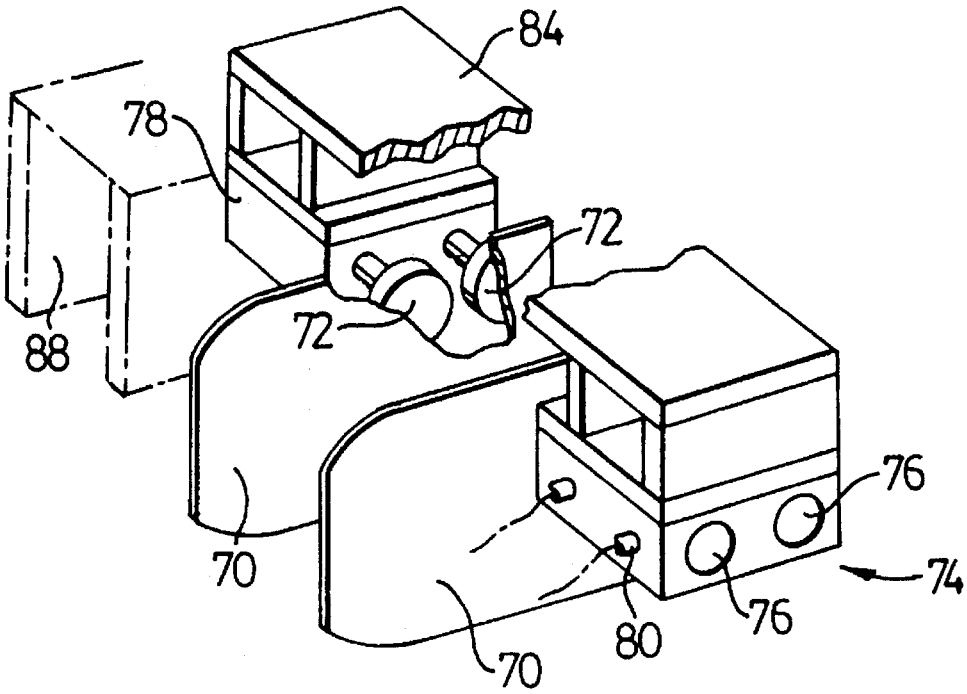

The bag transfer unit 42 is best illustrated in FIGS. 3 and 4 and as can be seen includes a pair of blades 70 moveable towards and away from one another. Each blade 70 is mounted on the ends of a pair of pistons 72 forming part of a pair of air cylinders 74. Each piston 72 extends outwardly from a chamber 76 forming the other part of the air cylinders 74. Each pair of air cylinders 74 is located on a support 78 which provides feeds 80 for compressed air to the air cylinders 74. When the chambers 76 are pressurized and depressurized, the pistons 72 reciprocate to move the blades 70 laterally with respect to one another.

The supports 78 are mounted on a frame assembly 82. The frame assembly includes a crossbar 84 which spans the top of the supports 78. A cantilever 86 has a bracket 88 at one end which is rigidly affixed to the bottom of mount 56 while its other end is fastened to the crossbar 84.

Linear slide 54 is very similar to linear slide 52 and includes a guide shaft 90 extending the length of the linear slide 54. The guide shaft 90 passes through a mount 92 which houses linear bearings to facilitate its movement along the shaft. The mount 92 is fastened to an endless belt 94 wound about a pair of pulleys 96 and 98 respectively. Pulley 98 is coupled to a reversible motor 100 in the housing 46 via belt 102. The motor 100 and belt 102 form the drive mechanism 50. Rotation of the motor 100 in either direction imparts rotation of pulley 98 via the belt 102. This action winds the belt 94 about the pulleys 96 and 98 to reciprocate the article holding unit 40 between a retracted position and an article holding position as will be described.

Figure 5:
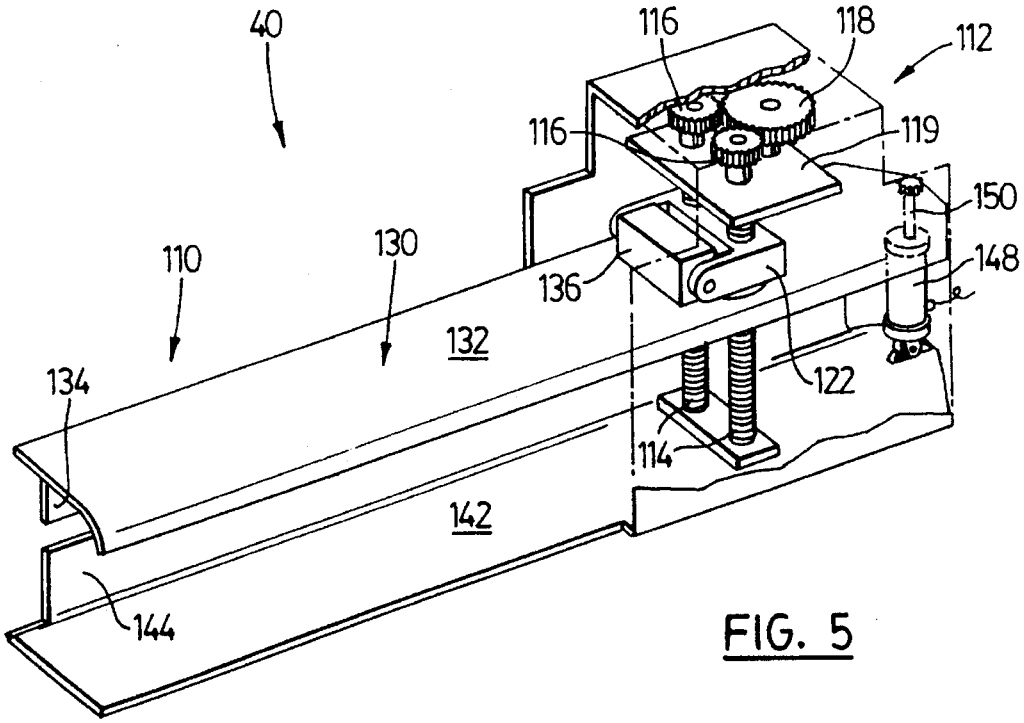
FIG. 5 is an enlarged perspective view of another portion of the apparatus for packaging articles shown in FIG. 1.
Figure 6:
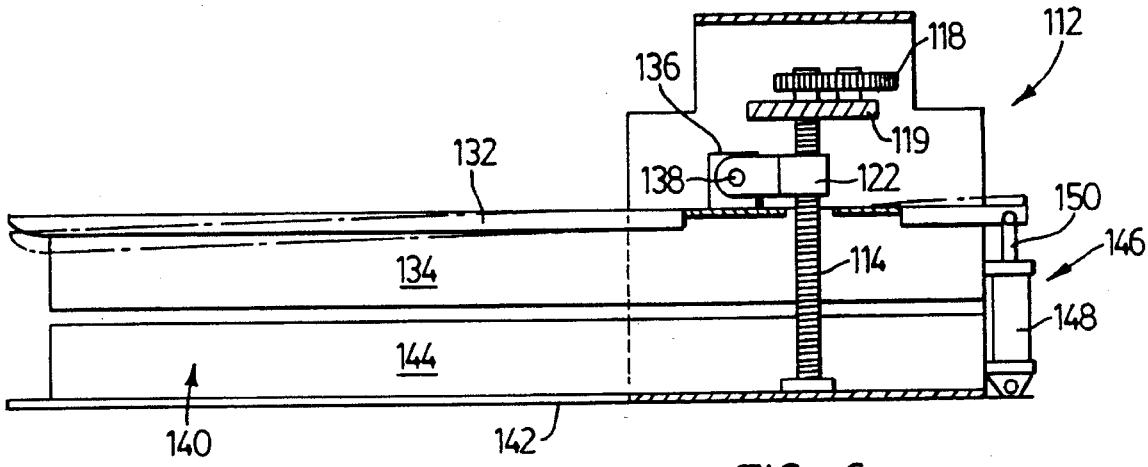
FIG. 6 is a sectional view of FIG. 5 taken along line 6—6.

The article holding unit 40 is best illustrated is FIGS. 5 and 6 and includes an article holder 110 and a housing 112 at one end of the holder 110. The top of the housing 112 is secured to the mount 92 by suitable fasteners. Within the housing 112 are a pair of threaded rods 114 rotatably mounted to the housing at their bottom ends. The top of each rod 114 terminates in a toothed gear wheel 116. A second gear wheel 118 mounted on support plate 119 meshes directly with one of the gear wheels 116 and meshes with the other gear wheel 118 via a pinion (not shown) so that rotation of gear wheel 118 imparts rotation of gear wheels 116 and hence the rods 114, in the same direction. A mount 122 threadably engages rods 114 and moves up and down the rods as the rods rotate. Another gear (not shown) meshes with gear 118 and has a shaft (not shown) which passes through the support plate 119. The shaft terminates at a small hand wheel (not shown) to allow the rods 114 to be rotated manually.

The holder 110 has an upper portion 130 which includes a top 132 having a downturned front edge and a back wall 134 depending from the top. A block 136 is on the top 132 within the housing 112 and is pivotally connected to the mount 122 via pivot pin 138. The holder 110 also includes a lower portion 140 vertically spaced from the upper portion 130. The lower portion 140 has a base 142 rigidly secured to the housing 112 and an upstanding back wall 144. An air cylinder 146 having its chamber 148 secured to the bottom of the housing 112 and its piston 150 secured to one end of the top 132, is located at the side of the housing 112 opposite the holder 110. When the air cylinder 146 is pressurized, the piston 150 extends to pivot the upper portion about the mount 122 and bring the distal end of the upper portion 130 towards the lower portion 140. This movement of the upper portion 130 is shown by the chain dot lines in FIG. 6. When the rods 114 are rotated via rotation of the hand wheel, the vertical spacing between the upper and lower portions 130 and 140 respectively can be adjusted to allow the apparatus 10 to be configured for different size articles.

A stop 150 having a vertical portion 152 and a horizontal stop arm 154 with an abutment plate 156 on its distal end extends from the housing 46. The stop 150 is rotatable through 180 degrees to swing the horizontal stop arm 154 from an operative position wherein the abutment plate 156 faces the bag transfer unit 42 to a retracted position wherein the abutment plate 156 faces the article holding unit 40.

On one side of the apparatus 10 is located a bag holding mechanism 170 which is best illustrated in FIGS. 8 and 9. The bag holding mechanism 170 includes a pair of wickets 172 mounted on a slide assembly 174. The side assembly includes a guide shaft 176 having both of its ends received in holders 176. The guide shaft 176 passes through mounts 180 on which the wickets 172 are fastened. The mounts 180 house linear bearings to facilitate their movement along the shaft 176.

Each wicket 172 includes a pair of cylindrical rods 182 mounted on a support plate 184 via a pair of vertically spaced holders 186. The support plates 184 in turn are fastened to one of the mounts 180. A support arm 190 bridges the top of the rods 182 while spring 192 surround each rod between the holders 186 and the support arm 190. A crank 194 is located below the shaft 176 and is supported by holders 196. Crankshafts 196 are mounted to the crank 194 at one of their ends and have their other ends mounted to one of the support arms 190. When the crank 194 is turned, the crankshafts 196 pull downwardly on the support arms 190 to compress the springs 192 and spring load the wickets. This movement of the wickets 172 is illustrated in FIG. 8 by the chain dot lines.

A bag support tray 200 having a pair of depending pins 202 is removably mounted on each support arm 190. The bag support tray also includes a horizontal plate 204 on which a stack of plastic bags 206 are placed. One of the wickets 172 is in line with the apparatus 10 and is positioned such that the horizontal plate 204 sits below a retainer 208. Adjacent the retainer 208 is a valved nozzle 210 which receives compressed air and outputs a flow of air towards the stack of plastic bags 206. The air flow is directed to inflate the top bag 212 of the stack to allow the blades 70 of the bag transfer unit 42 to enter the inflated bag 212 and remove it from the stack 206 as will be described.

The operation of the apparatus 10 will now be described with particular reference to FIGS. 7*a* to 7*e*. In operation, individual loaves of bread 22 are delivered to the apparatus 10 by the delivery conveyor line 14 at spaced intervals. When a loaf of bread 22 approaches the apparatus 10, it is detected by the electronic sensor (not shown). The electronic sensor provides a control signal to the controller within housing 67. At this point, the controller causes the apparatus 10 to initiate its packaging cycle. In particular, when a loaf of bread 22 is detected by the electronic sensor, the controller turns the drive mechanism 50 on so that the motor 100 imparts rotation of the pulley 98 and hence the belt 94 to bring the article holding unit 40 from its retracted position to one side of the delivery conveyor line 14 to its article holding position slightly downstream of th delivery conveyor line 14 (see FIG. 7*a*). In the article holding position, the article holding unit 40 is oriented such that the holder 110 catches the loaf of bread between its upper and lower portions 130 and 140 respectively as the loaf of bread 22 falls off the end of the delivery conveyor line 14.

Once this has been done, the controller permits pressurized air to be fed to the air cylinder 146 causing its piston 150 to extend. As described previously, this causes the upper portion 130 of the holder 110 to pivot about the mount 122 bringing the distal end of the upper portion towards the lower portion and compressing the loaf of bread 22 therebetween. This is done to ensure that the bag in which the loaf of bread is to be placed clears the holder 110 with ease and to squish over sized loaves of bread to a size which is easily packaged.

Figure 7A:
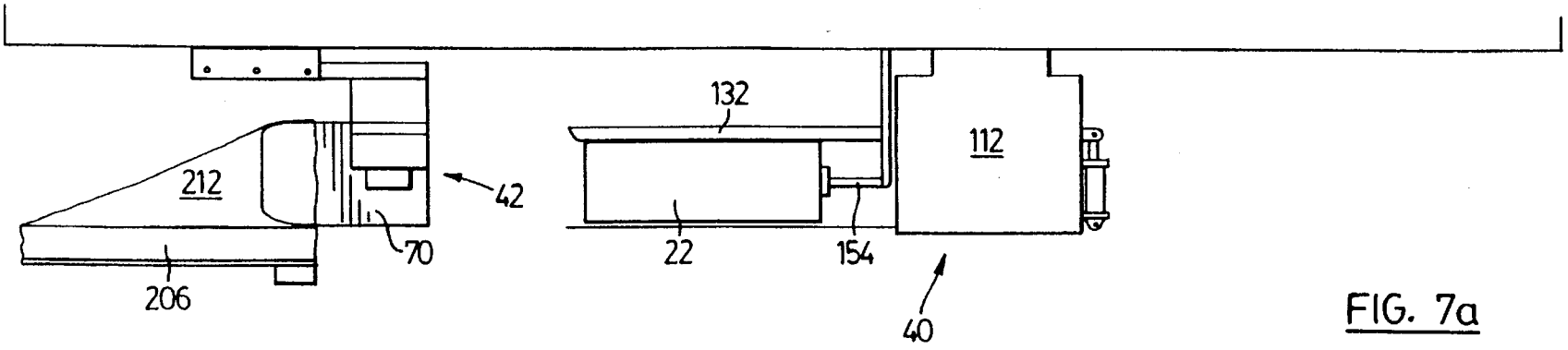
Figure 7B:
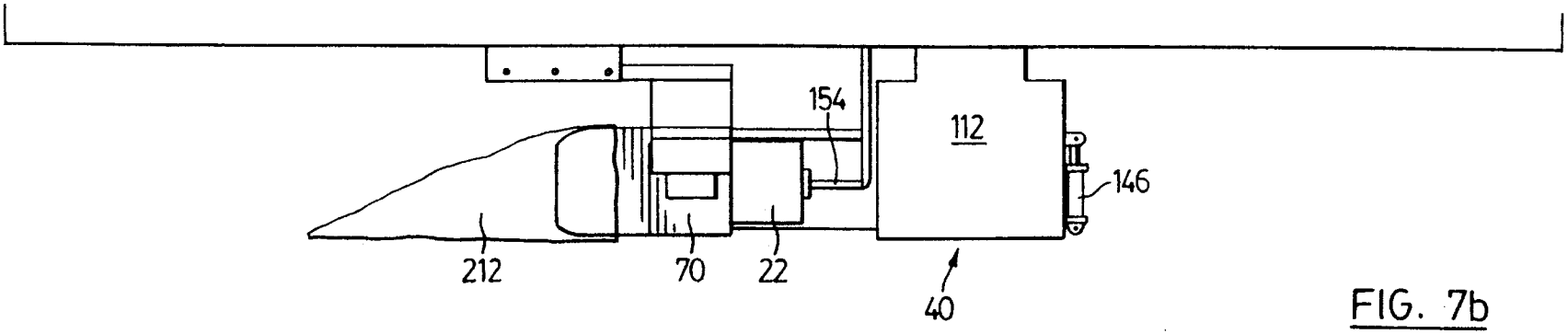
Figure 7C:
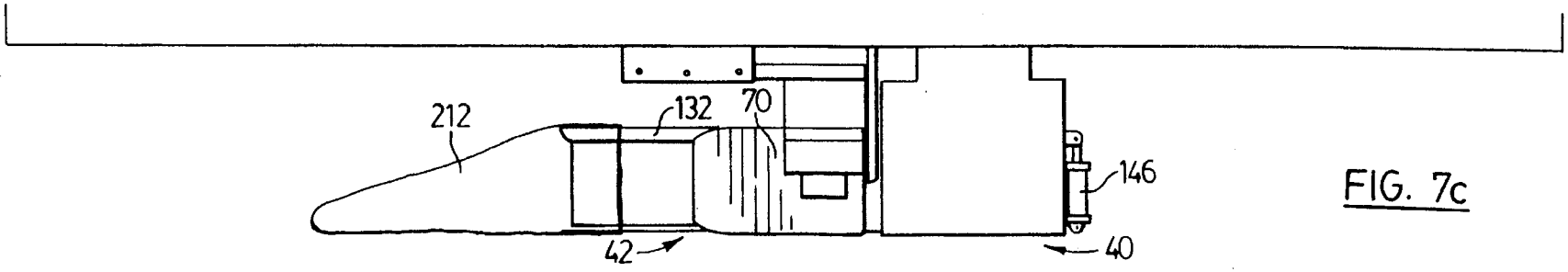
Figure 7D:
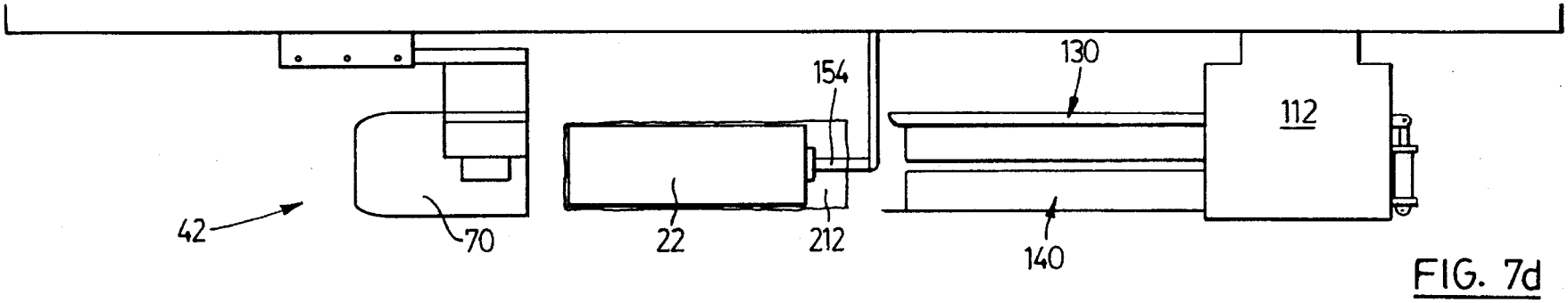
Figure 7E:
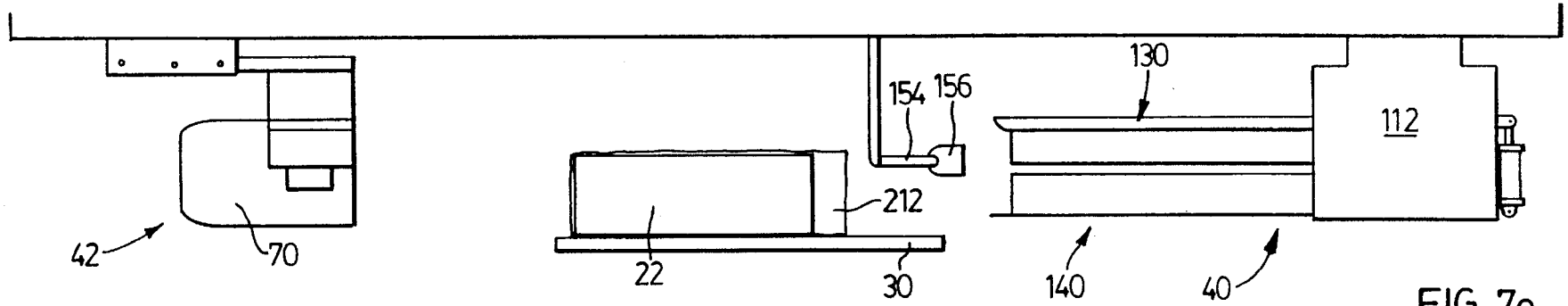

As the air cylinder 146 is being pressurized to move the upper and lower portions 130 and 142 relative to one another, the controller brings the bag transfer unit 42, which is holding an open plastic bag between its blades 70, towards the article holding unit 40 via the linear slide 52 (see FIG. 7*b*). This is achieved by actuating the drive mechanism 48 to rotate motor 64 and hence belt 58 to move the bag transfer unit 42 along the guide shaft 58. The bag transfer unit 42 is moved towards the article holding unit 40 until the bag held by the blades 70 is pulled over the holder 110. While this is occurring, the controller depressurizes air cylinder 146 to pivot the upper portion 130 away from the lower portion 140. This movement of the holder 110 stops the bag from moving with the bag transfer unit 42 as the bag transfer unit 42 continues moving towards the article holding unit 40 so that the blades 70 are removed from the bag (see FIG. 7*c*).

Once the blades 70 of the bag transfer unit 42 have cleared themselves from the bag, the controller stops the drive mechanism 48 and then reverses its direction to bring the bag transfer unit 42 back towards the bag holding mechanism 170 while ensuring that the blades 70 are spaced far enough apart to clear the article holding unit 40. As the bag transfer unit 42 approaches the bag holding mechanism, the controller actuates the compressed air supply so that the nozzle 210 releases pressurized air into the upper most bag 212 in the stack 206 to open the bag 212. At the same time, the controller causes pressurized air to be supplied to the air cylinders 76 to extend the pistons 72 to bring the blades 70 towards one another so that when the drive mechanism 48 brings the bag transfer unit 42 to the bag holding mechanism 170, the blades 70 enter the interior of the inflated bag. After this has been accomplished, the air supply to the nozzle 210 is discontinued and the air cylinders 76 are depressurized to move the plates 170 away from one another to grab the bag and pull it off the wicket 172.

While the bag transfer unit 42 is moving towards the bag holding mechanism 170 to collect another bag, the controller actuates the drive mechanism 50 in the opposite direction to move the article holding unit 40 to its retracted position. As this occurs, the article holding unit 40 brings the bag 212 with it while the abutment plate 156 contacts the end of the loaf of bread 22 to prevent it from moving with the article holding unit 40. Therefore, the stop 150 keeps the loaf of bread stationary as the holder 110 pulls the bag over the loaf of bread (see FIG. 7*d*). After the article holding unit has travelled a certain distance, the closed end of the bag 212 contacts the end of the loaf of bread. At this point, the stop 150 prevents further movement of the bag so that further movement of the article holding unit 40 brings the holder 110 out of the bag. Once the article holding unit 40 has moved a sufficient distance to bring the holder 110 completely out of the bag, the controller causes the stop to swivel out of the bag allowing the bagged loaf of bread to fall onto the transport conveyor line 16 (see FIG. 7*e*). The stop 150 is then swivelled back to its operative position and the apparatus 10 is in its original condition waiting for another cycle to begin. Another cycle begins as soon as the electronic sensor detects the approach of another loaf of bread.

The transport conveyor line 16 transports the bagged loaf of bread to a closing mechanism wherein a plastic closure tab can be affixed to the open end of the bag to seal it.

Because the wickets 172 are slidable along the shaft 176, when one wicket has been depleted of its supply of plastic bags 206, it can be slid out of the way and the other wicket 172 can be slid into position allowing the bag transfer unit 42 to collect bags from it. The depleted wicket can then be restocked with bags.

Referring now to FIG. 10, another embodiment of an apparatus for packaging articles is shown. In this embodiment, the apparatus is basically identical to that shown in FIGS. 1 to 9 with the exception that the wickets 170 are not used to supply plastic bags to the bag transfer unit. Rather, a roll stock machine 300 such as that manufactured by Frigo & Co. SRL, Italy under model no. FS-75 is used to supply bags to the bag transfer unit 42. As is know those of skill in the art, the roll stock machine 300 houses a roll of plastic bags separated by perforations and allows individual bags to be removed from the roll by the bag transfer unit 42 in the same manner described previously to package a loaf of bread. When using the roll stock machine, the bag support trays 200 are removed and the roll stock machine 300 is placed along the same side of the apparatus 10 as the wicket assemblies so that it delivers plastic bags in a manner to allow the bag transfer unit to remove the plastic bags one at a time and carry them towards the article holding unit.

These embodiments of the present invention provide advantages in that since the bag transfer unit and article holding unit are reciprocated towards and away from each other and their movement is limited to short strokes, the packaging speed of the apparatus 10 is increased significantly over prior art designs. In addition, the use of the holder 110 to compress the article prior to packaging ensures that all articles fit into the bag easily.

Referring now to FIGS. 11 to 14*b*, another embodiment of an apparatus for packaging articles is shown. The apparatus of this embodiment can be used in conjunction with the wickets 170 or with the roll stock machine 300. In the embodiment, the bag article holding unit 40 and bag transfer unit 42 are combined to form a single article bagging assembly 400. The assembly 400 is mounted on a linear slide frame 402. The linear slide frame 402 includes a linear slide 404 identical to the linear slides 52 and 54 described previously. Therefore, the linear slide 404 includes pulleys (not shown) at opposite ends of the linear slide frame 402 around which is wound an endless belt (not shown). A reversible servo-motor 406 drives one of the pulleys to wind the belt and reciprocate the article bagging assembly 400 along the linear slide 404.

The article bagging assembly 400 includes a curved upper blade 410 (best seen in FIGS. 14*a* and 14*b*) and a lower blade 412. At one end of the blade 410 is a flange 414. A drive 416 is connected between the flange 414 and the linear slide frame 402 and can be actuated by the controller to move the upper blade 410 vertically with respect to the lower blade as required.

Integrally formed with the lower blade 412 is a platform 420 having a back plate 422 and a base 424. A flange 426 interconnects the platform 420 and the linear slide frame 402. The platform 420 is designed to receive the article, in this case a loaf of bread to be packaged. A stop arm (not shown but similar to that shown in the previous embodiment) depends from the linear slide frame 402 above the platform 420. The stop arm is moveable linearly along the linear slide frame 402 between operative or inoperative positions.

In operation, individual loaves of bread are delivered to the apparatus. When a loaf of bread approaches the apparatus and is detected by the electronic sensor, the controller initiates the linear slide 404 to move the article bagging assembly 400 towards the bag holding mechanism 170 or 300. At this stage of the packaging cycle, the blades 410 and 412 are close together and can enter the inflated bag. When the blades have entered the inflated bag, the platform 420 is properly positioned with respect to the conveyor line so that it can receive and hold the loaf of bread to be packaged. As this is occurring, the drive 416 is operated to move the upper blade 410 vertically so that the bag is engaged between the blades. Once engaged, the controller reverses the direction of the linear slide 404 so that the article bagging assembly 400 moves linearly towards its original position bringing the bag and loaf of bread with it.

At this time, the stop arm is brought to its operative position and contacts one end of the loaf of bread preventing it from moving with the article bagging assembly 400. Thus, as the article bagging assembly continues to move away from the bag holding mechanism towards the end of the linear slide, the bag held between the blades 410 and 412 is pulled over the loaf of bread. When the loaf of bread enters the bag and contacts the end of the bag, further movement of the article bagging assembly 400 results in the blades 410 and 412 moving out of the bag since the stop arm prevents the loaf of bread from moving. Once the blades have been completely removed from the bag, the stop arm is moved linearly away from the bag allowing the bagged loaf of bread to fall onto the transport conveyor line.

We claim:

1. An apparatus for packaging articles comprising:

an article holding unit to receive and hold an article to be packaged;

a bag transfer unit to carry a bag in which said article is to be placed; and a drive acting on said article holding unit and said bag transfer unit, said drive reciprocating said article holding unit between an article holding position and a retracted position to one side apparatus and reciprocating said bag transfer unit between a bag collecting position adjacent an opposite side of said apparatus and an article packaging position wherein a bag carried by said bag transfer unit surrounds an article held by said article holding unit in said article holding position.

2. An apparatus as defined in claim 1 wherein in said article packaging position said bag also surrounds at least a portion of said article holding unit.

3. An apparatus as defined in claim 2 further including a stop contacting an article hold by said article holding unit and inhibiting movement of said article when said drive moves said article holding unit from said article holding position to said retracted position.

4. An apparatus as defined in claim 3 wherein said stop includes a stop arm moveable an operative condition to contact an article held by said article holding unit and an inoperative condition when said article holding unit is in said retracted position.

5. An apparatus as defined in claim 4 wherein said article holding unit and said bag transfer unit reciprocate along linear slides in line with one another, said units moving towards the centre of said apparatus when assuming said article holding and article packaging positions respectively.

6. An apparatus as defined in claim 5 wherein said drive moves said bag transfer unit towards said bag collecting position when said article holding unit is moved from said article holding position to said retracted position.

7. An apparatus as defined in claim 1 wherein said article holding unit includes a holder having a top portion and a bottom portion between which an article is held, said top and bottom portions being vertically spaced and moveable relative towards one another to compress an article held therebetween.

8. An apparatus as defined in claim 7 wherein said top portion is moveable towards said bottom portion.

9. An apparatus as defined in claim 8 wherein said top portion is pivotally mounted to said article holding unit, said article holding unit further including a second drive acting between said top and bottom portions to pivot said top portion to move said top portion relative to said bottom portion.

10. An apparatus as defined in claim 9 wherein said second drive is in the form of an air cylinder extending between said top and bottom portions.

11. An apparatus as defined in claim 10 wherein said article holding unit further includes adjustment means to alter the vertical spacing between said top and bottom portions to accommodate different size articles to be packaged.

12. An apparatus as defined in claim 1 further including a bag holding mechanism adjacent said opposite side, said bag transfer unit collecting a bag held by said bag holding mechanism when in said bag collecting position and carrying it to said article packaging position.

13. An apparatus as defined in claim 12 wherein said bag holding mechanism is removably mounted on said apparatus.

14. An apparatus as defined in claim 13 wherein said bag holding mechanism is in the form of a roll stock mechanism or a wicket supporting a stack of preformed bags.

15. An apparatus as defined in claim 14 wherein said apparatus further includes at least one air jet to inflate a bag to be collected by said bag transfer unit, said bag transfer unit including a pair of blades moveable relative to one another, said blades being closely positioned to enter an inflated bag in said bag collecting position and moveable away from one another to grasp said inflated bag and carry said bag to said article packaging position.

16. An apparatus for packaging articles comprising:

an article holding unit to receive and hold an article to be packaged, said article holding unit including a holder having a top portion and a bottom portion between which an article is held, said top and bottom portions being moveable relative towards one another to compress an article held therebetween;

a bag transfer unit to carry a bag in which said article is to be placed; and a drive acting on said article holding unit and said bag transfer unit, said drive moving said article holding unit between an article holding position and a retracted position and moving said bag transfer unit between a bag collecting position and an article packaging position wherein a bag carried by said bag transfer unit surrounds an article held by said article holding unit when in said article holding position.

17. An apparatus as defined in claim 16 wherein said top portion is moveable towards said bottom portion.

18. An apparatus as defined in claim 17 wherein said top portion is pivotally mounted to said article holding unit, said article holding unit further including a second drive acting between said top and bottom portions to pivot said top portion to move said top portion relative to said bottom portion.

19. An apparatus as defined in claim 18 wherein said second drive is in the form of an air cylinder extending between said top and bottom portions.

20. An apparatus as defined in claim 19 wherein said article holding unit further includes adjustment means to alter the vertical spacing between said top and bottom portions to accommodate different size articles to be packaged.

21. An apparatus for packaging articles comprising:

an article bagging assembly to receive and package an article; and a drive acting on said article bagging assembly, said drive reciprocating said article bagging assembly between a bag collecting position adjacent one side of said apparatus wherein a bag is collected by said assembly and an article packaging position wherein the article to be packaged is received by said assembly, said drive operating said assembly so that the bag carried by said assembly surrounds the held article in said article packaging position.

22. An apparatus as defined in claim 21 wherein said article bagging assembly assumes said bag collecting and article packaging positions at the same time.

23. An apparatus as defined in claim 22 wherein said article bagging assembly includes means to enter and engage a bag and means to receive the article, said receiving means being positioned to receive said article when said engagement means has entered said bag.

24. An apparatus as defined in claim 23 further including a bag holding mechanism adjacent said one side of said apparatus, said article bagging assembly collecting a bag held by said bag holding mechanism when in said bag collecting position.

25. An apparatus as defined in claim 24 wherein said bag holding mechanism is removably mounted on said apparatus.

26. An apparatus as defined in claim 25 wherein said bag holding mechanism is in the form of a roll stock mechanism or a wicket supporting a stack of preformed bags.

27. An apparatus as defined in claim 26 wherein said apparatus further includes at least one air jet to inflate a bag to be collected by said article bagging assembly, said article bagging assembly including a pair of blades moveable relative to one another, said blades being closely positioned to enter an inflated bag in said bag collecting position and moveable away from one another to grasp said inflated bag.

28. An apparatus as defined in claim 23 further comprising stop means, said drive moving said article bagging assembly in an opposite direction once a bag has been engaged and an article has been received, said stop means inhibiting movement of said article with said assembly to cause said article to enter said bag.

29. An apparatus as defined in claim 28 wherein said stop means is moveable to a retracted position once the article has entered the bag and the bag has been released from said engagement means.

* * * * *